US008079188B2

(12) United States Patent
Swartz et al.

(10) Patent No.: US 8,079,188 B2
(45) Date of Patent: Dec. 20, 2011

(54) ENERGY ABSORBING BLAST WALL FOR BUILDING STRUCTURE

(75) Inventors: Allan J. Swartz, Gardnerville, NV (US); Gregory Kulpa, Tustin, CA (US); A. Carleton Elliott, Newport Beach, CA (US)

(73) Assignee: Specialty Hardware L.P., Newport Beach, CA (US)

( * ) Notice: Subject to any disclaimer, the term of this patent is extended or adjusted under 35 U.S.C. 154(b) by 427 days.

(21) Appl. No.: 12/336,524

(22) Filed: Dec. 16, 2008

(65) Prior Publication Data

US 2009/0158679 A1 Jun. 25, 2009

Related U.S. Application Data

(60) Provisional application No. 61/015,195, filed on Dec. 20, 2007.

(51) Int. Cl.
*E04B 1/00* (2006.01)

(52) U.S. Cl. ..... 52/281; 52/479; 52/481.1; 52/653.1; 52/710; 52/167.1

(58) Field of Classification Search ..... 52/745.09, 52/281, 236.7, 241, 243.1, 474, 479, 480, 52/481.1, 482, 483.1, 653.1, 653.2, 710, 52/712, 714, 715, 1, 137.1, 167.4
See application file for complete search history.

(56) References Cited

U.S. PATENT DOCUMENTS 3,120,031 A * 2/1964 Bohnsack ..... 52/241
4,086,734 A * 5/1978 Hayashi ..... 52/126.4
4,103,463 A * 8/1978 Dixon ..... 52/126.4
4,188,758 A 2/1980 Swann
4,450,658 A * 5/1984 Legeai ..... 52/126.3
5,768,841 A * 6/1998 Swartz et al. ..... 52/281
6,176,053 B1 * 1/2001 St. Germain ..... 52/232
6,279,278 B1 * 8/2001 Morris et al. ..... 52/239
6,612,087 B2 * 9/2003 diGirolamo et al. ..... 52/712
7,299,593 B1 * 11/2007 diGirolamo et al. ..... 52/241

(Continued)

FOREIGN PATENT DOCUMENTS

JP 06-058006 U 8/1994

(Continued)

OTHER PUBLICATIONS refer to the included document Information Disclosure Statement, for a complete listing of the NPL refernece.*

(Continued)

*Primary Examiner* — Jessica Laux
(74) *Attorney, Agent, or Firm* — Jerry Turner Sewell

(57) ABSTRACT

A wall system protects a building structure from pressure caused by explosive blasts. The wall system includes vertical studs. Outer blast wall panels and inner blast wall panels are secured to the opposing sides of the vertical studs. An upper mounting system is attached to the building structure. An upper mounting system includes a fixed track, a movable mounting track, and an energy absorbing system that flexibly couples the movable mounting track to the fixed track. The upper ends of the vertical studs are attached to movable mounting track. A lower mounting system includes a mounting track that aligns the lower ends of the vertical studs. A respective attachment clip is attached to a lower portion of vertical stud. Each attachment clip is attached to the building structure with an energy absorption pad that resists vertical and lateral movement of lower end of the respective vertical stud.

16 Claims, 11 Drawing Sheets

U.S. PATENT DOCUMENTS

| | | | | |
|---|---|---|---|---|
| 7,735,295 | B2 * | 6/2010 | Surowiecki | 52/831 |
| 7,752,817 | B2 * | 7/2010 | Pilz et al. | 52/207 |
| 2002/0189172 | A1 * | 12/2002 | Kaeser et al. | 52/64 |
| 2006/0150573 | A1 | 7/2006 | Elliott, Jr. et al. | |
| 2007/0044407 | A1 | 3/2007 | Elliott | |
| 2008/0010932 | A1 * | 1/2008 | Elliott et al. | 52/404.1 |
| 2008/0313995 | A1 | 12/2008 | Elliott et al. | |

FOREIGN PATENT DOCUMENTS

| | | | |
|---|---|---|---|
| KR | 20-1999-0027289 | U | 7/1999 |
| KR | 10-2007-0098880 | A | 10/2007 |

OTHER PUBLICATIONS

Commissioner, Korean Intellectual Property Office, Form PCT/ISA/220, "Notification of Transmittal of the International Search Report and the Written Opinion of the International Searching Authority, or the Declaration," for International Application No. PCT/US2008/087447, Jun. 11, 2009, 4 pages.

Loc, Kim Bae, Authorized Officer, Korean Intellectual Property Office, Form PCT/ISA/237, "Written Opinion of the International Searching Authority," for International Application No. PCT/US2008/087447, Jun. 11, 2009, 3 pages.

Loc, Kim Bae, Authorized Officer, Korean Intellectual Property Office, Form PCT/ISA/210, "International Search Report," for International Application No. PCT/US2008/087447, Jun. 11, 2009, 3 pages.

Nickitas-Etienne, Athina, Authorized Officer, The International Bureau of WIPO, Form PCT/IB/326, "Notification Concerning Transmittal of the International Preliminary Report on Patentability," for International Application No. PCT/US2008/087447, Jul. 1, 2010, [1 page], with attached Form PCT/IB/326, "International Preliminary Report on Patentability," [1 page], with attached LOC, Kim Bae, Authorized Officer, Korean Intellectual Property Office, Form PCT/ISA/237, "Written Opinion of the International Searching Authority," for International Application No. PCT/US2008/087447, Jun. 11, 2009, [3 pages], 5 pages total.

* cited by examiner

ENERGY ABSORBING BLAST WALL FOR BUILDING STRUCTURE

BACKGROUND OF THE INVENTION

1. Field of the Invention

The present invention is generally in the field of protective wall structures for buildings, and, more particularly, is in the field of blast resistant walls.

2. Description of the Related Art

Current existing blast resistant wall assemblies attempt to resist the extreme forces generated by explosives with massively heavy and very costly components. The wall components endeavor to remain in place when impacted by a blast wave. If the wall components fail, the components are propelled into the interior space of the structure to damage equipment and harm people that the wall components are intended to protect.

SUMMARY OF THE INVENTION

A blast wall assembly and the components described herein form an integrated system that effectively absorbs blast energy. Unlike conventional systems, the components of the blast wall assembly function in a manner similar to highway "crumple zones" by absorbing the energy generated by the sudden impact of a blast wave on the exterior surface of the blast wall. The components of the blast wall assembly flex, move, compress, crush and bend before the full magnitude of the blast load is transmitted via the components to the fasteners used to secure the assembly to the structure. By absorbing the sudden impact of energy, the system greatly reduces the likelihood of component failure and fastener failure. Although the blast wall assembly may incur repairable damage, the blast wall assembly absorbs a substantial portion of the blast energy rather than imploding into the interior space of the structure. Thus, the blast wall assembly greatly enhances the safety of the building structure and the occupants of the building structure.

When a blast pressure wave first impacts an exterior blast board, the exterior blast board resists penetration by objects, such as rocks and shrapnel, which may be hurled against the wall by the blast force. A portion of the energy of the blast wave is absorbed by flexural bending of the exterior blast board. The load applied to the exterior blast board by the blast pressure wave is transferred to vertical wall studs. The exterior blast board also provides lateral bracing for the vertical studs, which helps prevent torsional failure of the light gauge vertical studs. The exterior blast board also serves as a substrate for a variety of exterior finish systems that may be applied to the cementitious wall board forming the outer face of the exterior blast board. Thus, from the outside, the blast wall assembly may be configured to have the cosmetic appearance of a conventional wall.

The light gauge (e.g., 16 gauge) vertical wall studs are flexible. Thus, when the load from the blast pressure wave is applied to the wall studs via the outer blast pane, the wall studs bend and deform and eventually stretch. The magnitude of deformation of the wall studs may exceed the yield strength of the wall studs and cause a portion of the deformation to be permanent. The bending, deformation and stretching of the studs absorbs additional blast energy.

As each vertical wall stud deforms inward away from the blast force, the stud has a tendency to pull out of an upper mounting channel and a lower mounting channel that constrain the upper end and the lower end, respectively, of each stud. An angle clip at the top of each vertical stud and an angle clip at the bottom of each stud resist this pull-out force while simultaneously absorbing blast energy. As the vertical stud deflects inwardly, the chord distance between the top end and the bottom end of the stud shortens. The angle clips have horizontal legs that deform by bending in response to the tensile force that attempts to straighten the angle clips. The deformations of the angle clips absorb additional blast energy.

When the bottom angle clip deforms, the tendency of the bottom angle clip to straighten is resisted by a bottom energy absorbing pad. The bottom energy absorbing pad is compressed vertically as the horizontal leg attempts to pull away from the lower mounting channel. The compression of the bottom energy absorbing pad absorbs additional blast energy. A metal plate laminated to the top of the bottom energy absorbing pad helps prevent the pad from pulling over an anchor bolt at the bottom of the wall and prevents the pad from being crushed by a hexagonal nut that secures the pad to the bottom attachment anchor bolt.

The bottom energy absorbing pads at the bottoms of the wall studs also absorb energy while allowing the entire base of the wall to move inward away from the blast. As described herein, the bottom mounting channel (or track) and the bottom clips include respective slots (or oversized holes) that permit the entire lower portion of the blast wall assembly to move inward away from the blast force until reaching the end of the slot or the boundary of the oversized hole. The bottom energy absorbing pads prevent the wall from moving too quickly and applying a shock load to the lower anchor bolts. When the bottom energy absorbing pads compress under load, the pads create a more gradual (cushioned) increase in the load to the wall anchors. Thus, the bottom energy absorbing pads help preserve the integrity of the critical attachment of the wall to the building structure.

An upper mounting system and an upper energy absorbing assembly at the top of the blast wall assembly absorb blast energy and resist destructive movement caused by the blast energy. The upper mounting system and the upper energy absorbing assembly also permit the floor above the blast wall assembly to deflect vertically in response to changing live loads to the floor above the wall, the floor below the wall or both. The floating configuration of the upper mounting allows deflections to occur without transferring axial loads (e.g., bearing loads) to the wall. The blast wall assembly disclosed herein can be used as either a non-bearing partition wall or as a curtain wall.

When a top angle clip deforms, the tendency of the clip to straighten is reduced by the bending of a horizontal flange stud that spans the distance between adjacent upper mounting systems. The tensile force caused by a blast causes the angle clip to bend (e.g., straighten) and induces weak axis bending in the horizontal flange stud. The horizontal flange stud also provides an engagement between the vertical wall studs and an upper blast track. In particular, the outer surfaces of the vertical walls of the horizontal flange stud ride may float up or down within the cavity formed by the upper blast track. The floating engagement between the horizontal stud and the upper blast track is configured to reduce the effect of the blast forces. As described herein, the top angle clip and the horizontal flange stud are nested so that the side walls of the horizontal flange stud are unobstructed within the upper blast track to thereby accommodate vertical movement between the floor above and the wall below. Additional blast energy is absorbed by bending of the horizontal stud flange and bending of the flange of the upper blast track on the side of the wall opposite the blast. Both components bend in a direction normal to the plane of the wall.

Lateral movement of the blast wall assembly in a direction normal to the wall plane is primarily resisted by bending of a down-turned flange of the upper blast track. As each vertical stud bends, the chord distance between the upper and lower ends of the vertical stud shortens as discussed above. A spring or other elastic member in the upper energy absorption assembly compresses to absorb blast energy. Once the spring in the energy absorbing assembly is fully compressed, a threaded steel rod in the assembly transmits tensile loads to the upper blast track through the anchor wedge washer. As the wall deforms inward, the threaded rod pivots to transfer tensile load and shear load to the upper blast track, which causes the upper blast track to deform in the vicinity of the wedge washer. The deformation of the upper blast track absorbs more blast energy.

Once the blast load is transferred to the upper blast track by bending the outer wall (flange of the upper blast track) and by the upper energy absorption assembly, the transferred load is transferred to the building structure by way of an upper anchor bolt embedded in a header. The force transferred to the upper anchor bolt is cushioned by the deformation of a trapezoidal channel in the upper blast track and by the vertical flange and weak axis bending of a U-shaped blast track anchor channel. The shape of the blast track in combination with the blast track anchor channel results in a more gradual transfer of forces to the top connection, which helps preserve the integrity of the top connection and of the blast wall assembly.

The blast wall assembly further comprises an interior blast board. Each panel of the interior blast board comprises a layer of metal and an interior finish wall board to form a generally rectangular sheet. The interior blast board is fabricated with a metal flange extending along one of the long edges. The long edges are oriented horizontally in the preferred embodiments. The metal flange allows the interior sheathing to be spliced to the adjacent sheathing (the inner blast panel immediately above). The splice effectively connects the upper and lower sheathing boards to form a continuous protective curtain reaching from the top to the bottom of the wall. If one or more sheets become dislodged, the dislodged sheets remain in place on the wall and pose no hazard to the building occupants. Preferably, the sheets are positioned on the wall with the locations of the splices staggered so that the splices do not coincide with the utility punch outs in the vertical studs of the wall. Thus, the interior blast board reinforces the wall and helps prevent stud failure at the utility punch-outs. Furthermore, the metal lined interior blast boards provide torsional restraint for the vertical studs to effectively prevent torsional failure of the vertical studs.

BRIEF DESCRIPTION OF THE DRAWINGS

The foregoing aspects and other aspects of this disclosure are described in detail below in connection with the accompanying drawing figures in which.

DETAILED DESCRIPTION OF A PREFERRED EMBODIMENT

Figure 1:
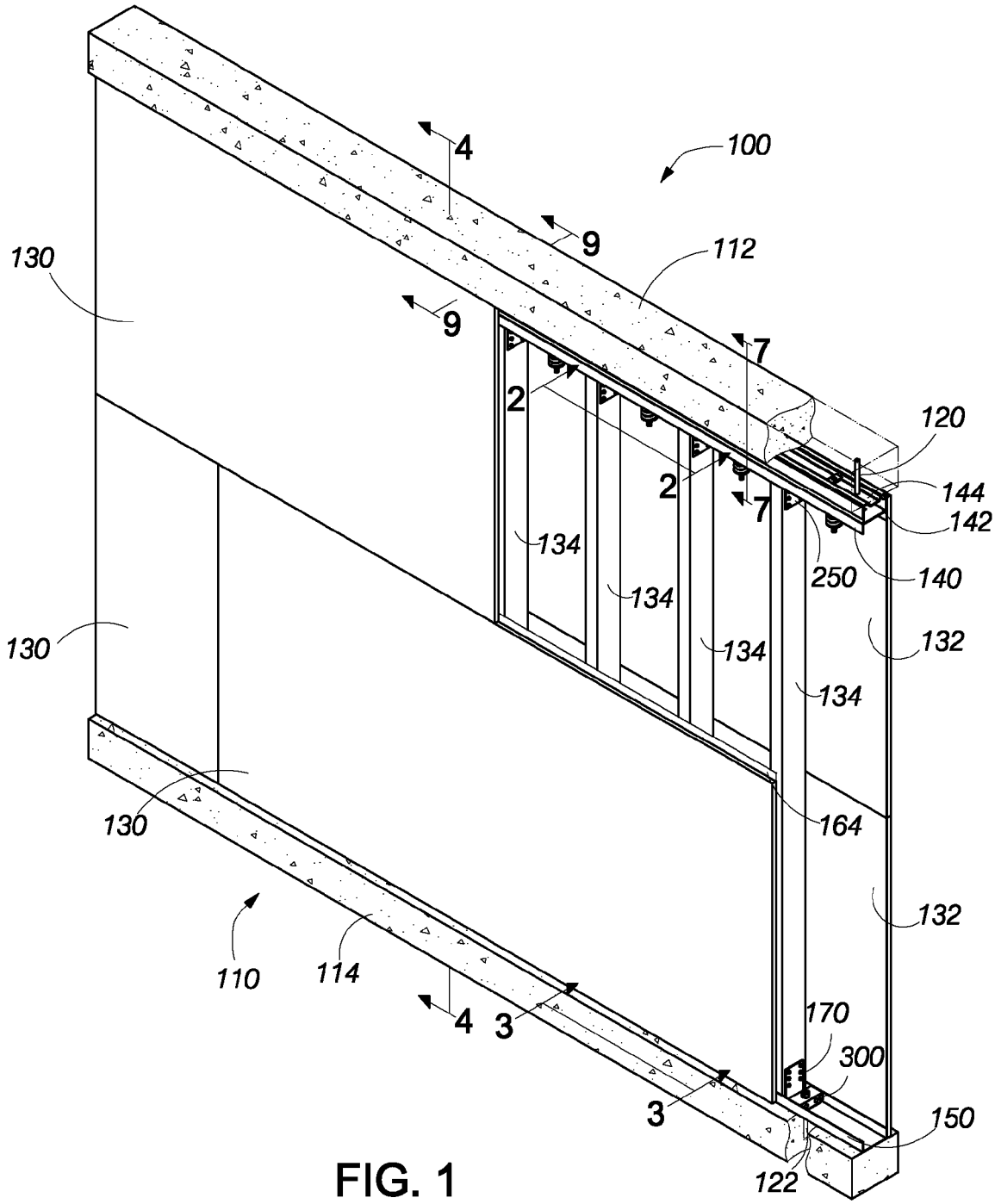
FIG. 1 illustrates a perspective view of a blast wall installed between an upper concrete header and a lower concrete footer with respective portions of the header and footer removed to show the mounting anchor bolts.

FIG. 1 illustrates a perspective view of a blast wall 100. The blast wall comprises a blast wall assembly 110 installed between an upper header 112 and a lower footer 114. In the illustrated embodiment, the header and the footer comprise concrete; however, the header, the footer or both may comprise other suitable materials. In the illustrated embodiment, the blast wall assembly is secured to the header and the footer by a plurality of upper anchor bolts 120 (one of which is shown in the broken section of the header) and a plurality of lower anchor bolts 122 (one of which is shown in the broken section of the footer). In the illustrated embodiment, the upper anchor bolts are advantageously spaced apart by approximately 24 inches and the lower anchor bolts are advantageously spaced apart by 16 inches. In other configurations, the distances between the anchor bolts may be different.

As further shown in FIG. 1, the blast wall assembly 110 comprises a plurality of inner blast panels (interior blast boards) 130 and a plurality of outer blast panels (exterior blast boards) 132 mounted on a plurality of vertical wall studs 134. The vertical studs advantageously comprise conventional light gauge metal studs having a C-shaped cross section. For example, in the illustrated embodiment, each metal stud has a main body portion having an outside width of approximately 4 inches, has opposing side walls that extend approximately 2 inches perpendicular to the main body portion, and has flanges that extend inwardly perpendicular to the side walls for approximately ½ inch. In one embodiment, each metal stud comprises 16 gauge steel having a thickness of approximately 1/16 inch. The width of the main body of each stud may be increased to increase the overall thickness of the blast wall assembly. The vertical studs are advantageously spaced apart by a conventional distance. In the illustrated embodiment, the vertical studs are spaced apart by approximately 16 inches. For additional wall strength, the vertical studs may be spaced apart by 12 inches, for example.

Figure 20:
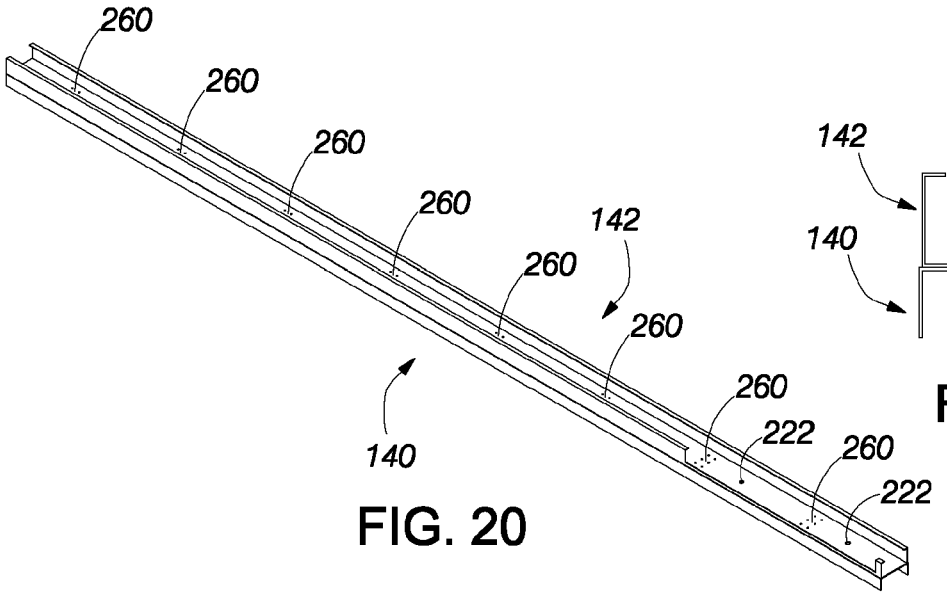
FIG. 20 illustrates a perspective view of the upper horizontal stud of FIG. 1 mounted to the upper mounting channel (track) of FIG. 1 to show the holes for mounting the energy absorption assembly and to show the pilot holes for mounting the upper stud attachment clip of FIG. 14.
Figure 21:
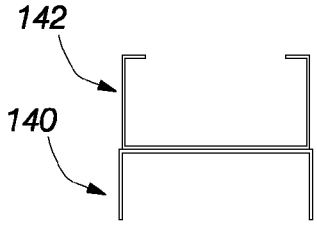
FIG. 21 illustrates an end elevational view of the joined upper horizontal stud and upper channel of FIG. 20 to show preferred cross sections for the joined components.

As further shown in FIG. 1, the upper end of each vertical stud 134 is mounted to an upper mounting channel (track) 140, which is advantageously a modified conventional mounting channel for a metal-framed building. For example, as shown in FIGS. 20 and 21, the upper channel advantageously comprises 16 gauge steel formed into a generally U-shaped profile having a base portion with an inner width of approximately 4 inches between two perpendicular side walls. In particular, the inner width of the upper channel is sized to accommodate the outer width of each vertical stud. Accordingly, for thicker walls having vertical studs with a greater base size, the inner width of the base of the upper channel is increased accordingly. In the illustrated embodiment, the side walls have lengths of approximately 1.5 inches. The open face of the U-shaped profile is positioned fastened downwardly to receive the upper end of each vertical stud.

Unlike an upper channel in a conventional metal-framed wall structure, the upper mounting channel 140 in FIG. 1 is not fixedly attached to the upper header 112. Rather, as described below in more detail, the upper channel is mounted to an upper horizontal stud 142, which advantageously comprises a conventional C-shaped framing stud positioned horizontally rather than vertically. In the illustrated embodiment, the horizontal stud has a profile and dimensions that correspond to the profile and dimensions of the vertical studs 134 as described above. The open portion of the horizontal stud faces upwardly so that the back of the horizontal stud rests on the back of the downwardly facing upper mounting channel. As described below, the horizontal stud and the upper mounting channel are fastened together and are shown as a unit in FIGS. 20 and 21. The width of the horizontal stud in the illustrated embodiment is 4 inches in the illustrated embodiment. The width of the horizontal stud is increased to correspond to the width of the vertical stud 134 if the thickness of the blast wall assembly 110 is increased.

As further described in more detail below, the horizontal stud 142 fits within a downwardly facing opening in a generally M-shaped upper blast track 144, which is shown in more detail in FIGS. 18 and 19. As illustrated, the upper blast track does not have a flat base. Rather, a central portion of the base is depressed to form a generally trapezoidal depression 146. The upper blast track is secured to the upper header 112 by the upper anchor bolts 120 by an upper mounting system described below. The horizontal stud and the upper mounting channel are not fixedly attached to the upper blast track and are free to move up and down as a unit within the upper blast track. Accordingly, the engagement between the horizontal stud and the upper blast track provide a floating mounting structure.

In the illustrated embodiment, the upper blast track 144 has an inside width of approximately 4 inches to accommodate the outside width of the upper horizontal stud 142. The inside width is increased to accommodate a wider horizontal stud if the thickness of the blast wall assembly 110 is increased. The generally trapezoidal depression 146 maintains the same size and shape even if the overall width of the upper blast track is increased for a thicker blast wall assembly. In particular, the depression causes the base of the upper blast track to protrude approximately 0.676 into the inner cavity of the upper blast track. The protrusion has a width within the cavity of approximately of approximately 2.434 inches.

As further shown in FIG. 1, the lower end of each vertical stud 134 is mounted to a lower mounting channel (track) 150, which is also advantageously a modified conventional mounting channel for a metal-framed building having a structure and dimensions similar to the upper channel 140. Unlike the lower channel in a conventional metal-framed wall structure, the lower channel in FIG. 1 is not fixedly attached to the lower header 114. Rather, as described below in more detail, the lower channel is mounted to the lower header in a manner that allows the lower channel to move laterally. Also, the lower end of the vertical stud is mounted within the lower channel to allow the vertical stud to move by a limited amount within the lower channel.

In the illustrated embodiment, each of the inner blast panels 130 and the outer blast panels 132 is generally rectangular and has a length greater than the width. The blast panels are mounted on the respective insides and outsides of the vertical studs with the longer dimension mounted horizontally as shown to reduce the number of vertical seams in the finished panels. Thus, each of the inner wall and the outer wall has at least two courses (rows) of panels. For example, the blast wall assembly 110 illustrated in FIG. 1 has a height of approximately 8 feet and comprises two rows of panels. A twelve-foot wall advantageously comprises three rows of panels. As further illustrated in FIG. 1, in preferred embodiments, the vertical seams in adjacent rows are staggered to reduce the overall length of a continuous vertical seam.

Figure 8:
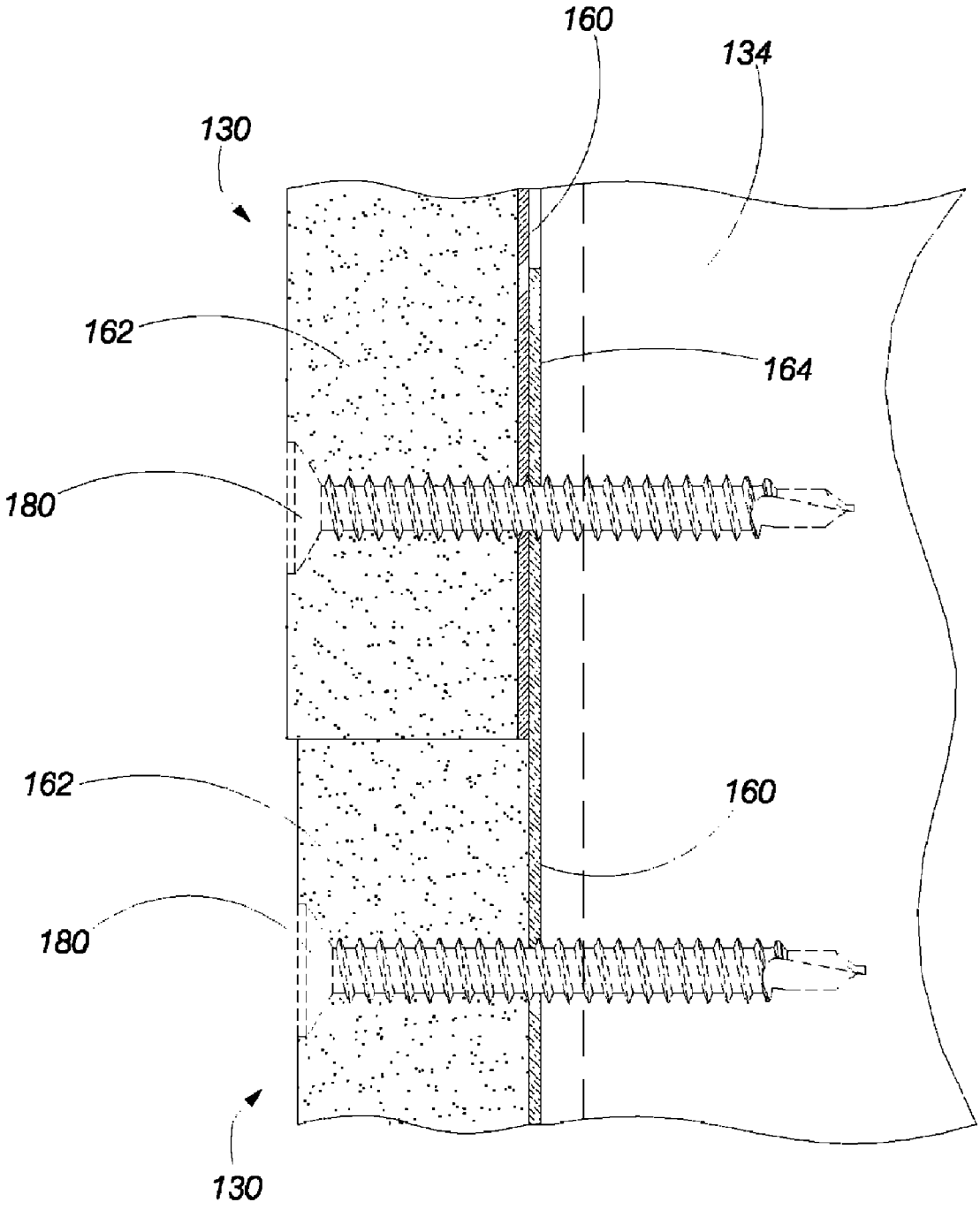
FIG. 8 illustrates an enlarged cross-sectional view of a portion of the overlap of an upper inner blast panel with respect to a tab extending upward from a lower inner blast panel which is bounded by the circular area 8 in FIG. 4.
Figure 9:
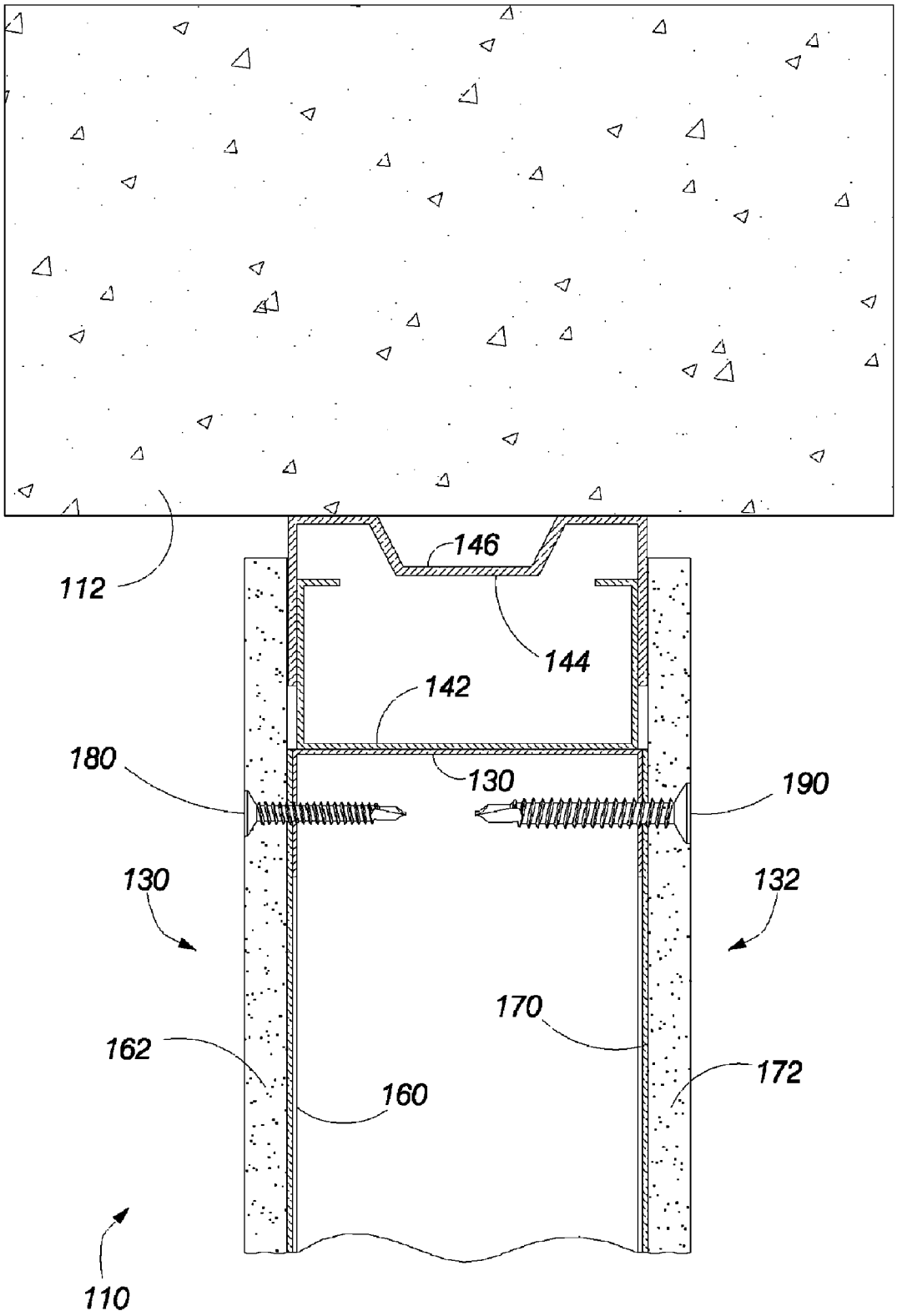
FIG. 9 illustrates an enlarged cross-sectional view in the direction of the lines 9-9 in FIG. 1 to show the mounting of the inner blast panel and the outer blast panel to the upper mounting channel (track)

As shown in more detail in FIGS. 8 and 9, for example, each inner blast panel 130 advantageously comprises a metal sheet 160 bonded to an interior wall board 162 using a suitable adhesive, such as, for example, an epoxy or a glue. The adhesive is cured (e.g., dried) while applying pressure to the two layers of materials to form the laminated inner blast panel. The inner blast panel is advantageously constructed in accordance with the technique described in U.S. Pat. No. 5,768,841, which is incorporated by reference herein. In the illustrated embodiment, the steel sheet advantageously comprises 20 gauge (approximately 0.0346 inch thick) galvanized steel. The inner blast panels are mounted against the metal studs 134 with the metal sheet against the metal studs.

In the illustrated embodiment, the interior wall board 162 has a conventional rectangular configuration with a width of approximately 4 feet and has a length of approximately 8 feet; however, the interior wall board may have other dimensions. For example, in other embodiments, the interior wall board may have a length of approximately 12 feet to reduce the number of seams between inner blast panels. In particular embodiments, the wall board comprises a highly mold-resistant interior gypsum board, such as, for example, ⅝ inch DensArmor Plus® paperless interior drywall, which is commercially available from Georgia-Pacific Building Products of Atlanta, Ga. Other suitable interior wall board materials may be advantageously used.

In the preferred embodiment shown in FIG. 1, the metal sheet 160 has substantially the same length as the interior wall board 162. The metal sheet may also have substantially the same width as the interior wall board; however, in the illustrated embodiment, the metal sheets of at least the inner blast panels 130 for the lower row of panels preferably has a greater width. In particular, as shown in FIG. 8, a portion of the metal sheet extends beyond one of the longer edges of the wall board to form an exposed metal tab 164 having a width of approximately 1¼ inches. As further shown in FIG. 8, a panel in the upper row of panels is positioned over the metal tabs of the panel in the next lower row of panels. Accordingly, when the inner blast panels are secured to the metal studs, the metal sheets form a continuous vertical diaphragm across against the metal studs. The metal tab is not needed for the uppermost row of inner blast panels. The metal tab may be removed. Alternatively, the inner blast panels may be provided without tabs for installation on the uppermost rows.

As shown in FIG. 9, for example, the outer blast panel 132 has a configuration similar to the configuration of the inner blast panel 130. The outer blast wall advantageously comprises a metal sheet 170 bonded to an exterior wall board 172 using a suitable adhesive, such as, for example, an epoxy or a glue. The adhesive is cured (e.g., dried) while applying pressure to the two layers of materials to form the laminated inner blast panel. The outer blast panel is advantageously constructed in accordance with the technique described in U.S. Pat. No. 5,768,841, which is incorporated by reference herein. In the illustrated embodiment, the steel sheet advantageously comprises 14 gauge (approximately 0.071 inch thick) galvanized steel. The outer blast panels are mounted against the metal studs 134 with the metal sheet against the metal studs.

In the illustrated embodiment, the exterior wall board 172 has a conventional rectangular configuration with a width of approximately 4 feet and has a length of approximately 8 feet; however, the exterior wall board may have other dimensions. For example, in other embodiments, the exterior wall board may have a length of approximately 12 feet to reduce the number of seams between outer blast panels. In particular embodiments, the exterior wall board comprises a highly mold-resistant exterior cement board, such as, for example, ⅝ inch Durock® brand cement board, which is commercially available from USG Corporation of Chicago, Ill. Other suitable exterior wall board materials may be advantageously used.

In the illustrated embodiment, the metal sheet 170 of the outer blast panel 132 advantageously has dimensions generally corresponding to the dimensions of the exterior wall board 172; however, the metal sheet may be wider to provide a tab (not shown) similar to the tab 164 described above for the inner blast panel 130.

As shown in FIGS. 8 and 9, each inner blast panel 130 is secured to the plurality of vertical studs 134 by a plurality of inner wall fasteners 180. For example, in the illustrated embodiment, the inner wall fasteners advantageously comprise No. 8 Senco® Duraspin screws commercially available from Senco Products of Cincinnati, Ohio. The inner wall fasteners are spaced apart by a selected distance along the vertical studs. For example, in the illustrated embodiment, the inner fasteners are spaced apart by a center-to-center distance of approximately 6 inches. Each inner blast panel in the upper row is also advantageously secured to the upper channel 140 by a plurality of the selected fasteners, which are also spaced apart by a suitable distance (e.g., 6 inches). Furthermore, the lower portion of each inner blast panel in the upper row is fastened to the tab 164 of the inner blast panels which the upper panel overlaps by inserting fasteners in the areas spanning between adjacent vertical studs. Each inner wall fastener has a flat head and is driven into the inner blast panel until the head of the fastener is flush with the exposed surface of the inner blast panel. Thus, when the structure of the blast wall assembly 110 is completed, the exposed surfaces of the inner blast panels may be finished in a conventional manner so that the wall has the appearance of a conventional wall.

As shown in FIG. 9, each outer blast panel 132 is secured to the side walls of a plurality of vertical studs 134 by a plurality of outer wall fasteners 190. For example, in the illustrated embodiment, the outer wall fasteners advantageously comprise a 3/16 inch or ¼ inch Kwik-Con concrete screws commercially available from Hilti, Inc. of Tulsa, Okla. The outer wall fasteners are spaced apart by a selected distance along the vertical studs. For example, in the illustrated embodiment, the outer wall fasteners are spaced apart by a center-to-center distance of approximately 4 inches. Each outer blast panel in the upper row is also advantageously secured to the upper channel 140 by a plurality of the selected fasteners, which are also spaced apart by a suitable distance (e.g., 6 inches). If the lower outer blast panels include tabs (not shown), the lower portion of each outer blast panel in the upper row is fastened to the tab of the outer blast panels which the upper panel overlaps. Each outer wall fastener has a flat head and is driven into the outer wall panel until the head of the fastener is flush with the exposed surface of the outer wall panel.

Figure 2:
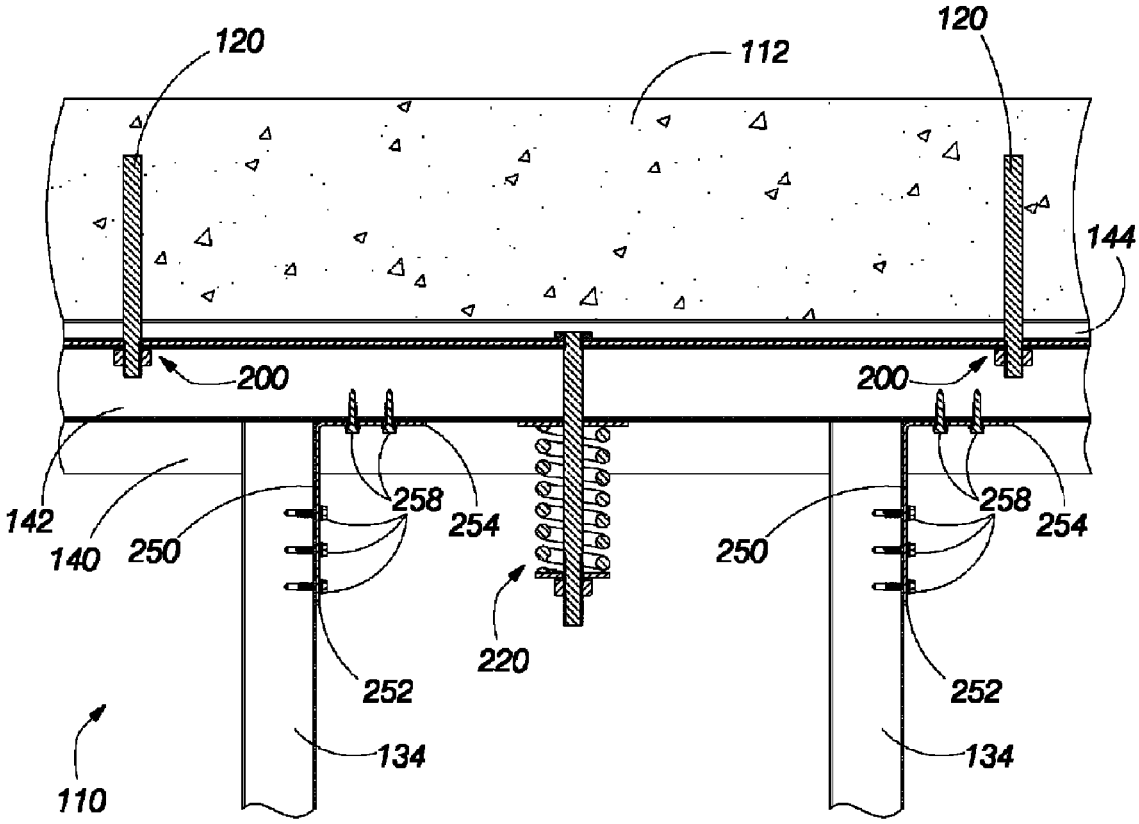
FIG. 2 illustrates an enlarged cross-sectional elevational view of a portion of the upper concrete header, the mounting tracks, the upper ends of two vertical studs and an energy absorption assembly between the vertical studs viewed in the direction of the lines 2-2 in FIG. 1.

FIG. 2 illustrates an enlarged cross-sectional elevational view of a portion of the upper concrete header 112, the upper blast track 144, the horizontal stud 142, the upper mounting channel 140, and the upper ends of two vertical studs 134 viewed in the direction of the lines 2-2 in FIG. 1.

Figure 10:
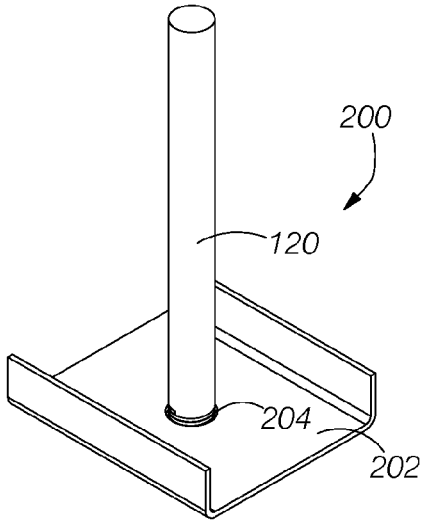
FIG. 10 illustrates a perspective view of the blast track anchor channel mounted to the upper anchor bolt.
Figure 11:
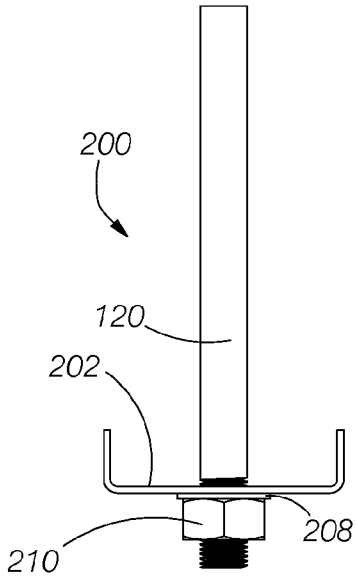
FIG. 11 illustrates an end elevation view of the blast track anchor channel and the upper anchor bolt of FIG. 10.

FIG. 2 further illustrates an upper mounting system 200 that secures the upper blast track 144 to an upper anchor bolt 120. The mounting system is shown in more detail in a cross-sectional end view in FIG. 5 and is also shown in a perspective view in FIG. 10 and an elevational view in FIG. 11. As illustrated, the upper mounting system comprises a generally U-shaped blast track anchor channel 202. The anchor channel advantageously comprises 14 gauge steel having a thickness of approximately 0.071 inch. The base of the anchor channel has an inside width of approximately 2.434 inch, which is selected to be substantially the same as outside width of the trapezoidal depressed portion 146. Each leg of the anchor channel has an inside length of approximately 0.676 inch, which corresponds to the height of the protrusion within the cavity of the upper blast track. The base of the anchor channel has a circular hole 204 formed approximately in the middle.

The hole has a diameter of approximately 9/16 inch to accommodate the outer diameter of the upper mounting anchor 120.

Figure 5:
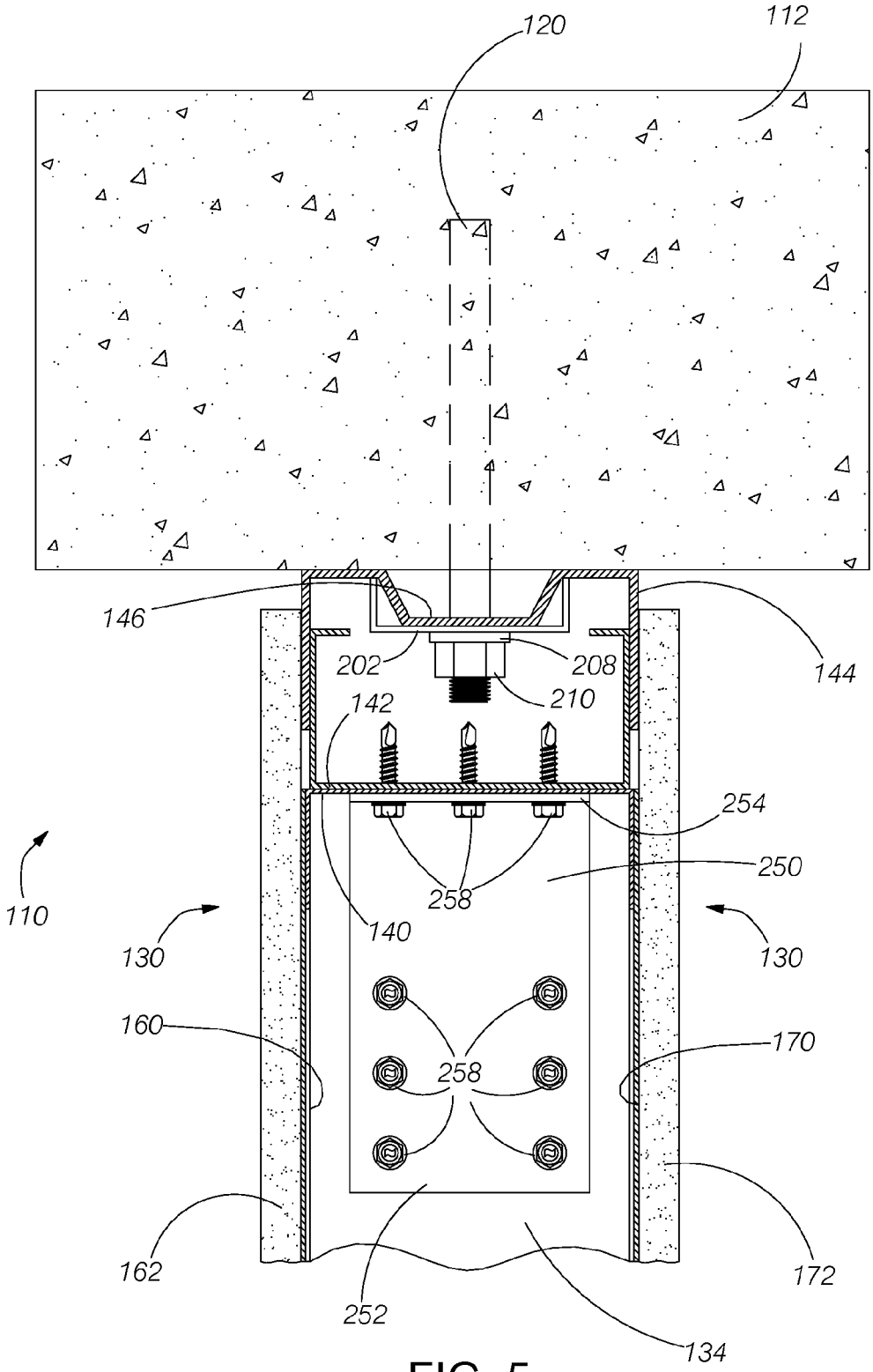
FIG. 5 illustrates an enlarged cross-sectional elevational end view of the top portion of the vertical wall stud of FIG. 4 bounded by the circular area 5 in FIG. 4.
Figure 18:
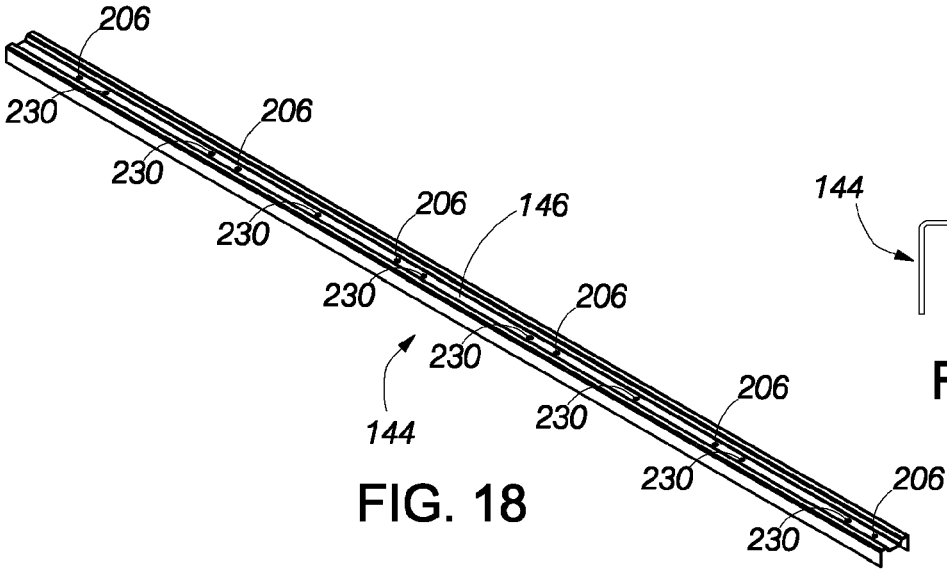
FIG. 18 illustrates a perspective view of the upper blast track of FIG. 1 to show the holes for mounting the upper blast track to the upper concrete header and showing the holes for mounting the energy absorption assembly to the blast track.
Figure 19:
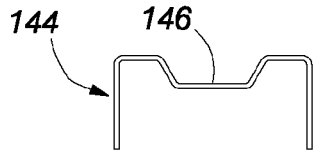
FIG. 19 illustrates an end elevational view of the upper blast track of FIG. 18 to show a preferred cross section for the upper blast track.

As shown in FIG. 18, the upper blast track 144 has a first plurality of mounting holes 206 substantially along a center line through the depressed portion 146. Each of the first plurality of mounting holes has a diameter corresponding to the diameter of the hole in the blast track anchor channel 202. The first plurality of mounting holes in the upper blast track are spaced apart by approximately 24 inches to correspond to the spacing of the upper anchor bolts in the upper header 112. As shown in FIG. 5 for one blast track anchor channel and one upper anchor bolt, the upper blast track is positioned with the upper anchor bolt positioned through a hole in the blast track, and the blast track anchor channel is positioned with the open portion of the U shape facing upward so that when the blast track anchor channel is positioned with the upper anchor bolt through the hole, the blast track anchor channel is positioned with the two legs surrounding the protruding portion of the depressed portion of the upper blast track and with the inside of the base of the blast track anchor channel positioned against the inner wall of the depressed portion.

The upper mounting system 200 further includes a standard washer 208 and a hex nut 210. The hex nut engages the threaded end of the upper anchor bolt 120 and secures the blast track anchor channel 202 to the upper anchor bolt. The legs of the blast track anchor channel are substantially perpendicular to the base of the blast track anchor channel. The blast track anchor channel resists compression when the nut is tightened onto the upper anchor bolt. In the absence of the blast track anchor channel, the trapezoidal shape of the upper blast track 144 would tend to flatten out as the nut is tightened. Thus, the blast track anchor channel reinforces the upper blast track and also prevents the upper blast track from deforming.

FIG. 2 further illustrates an upper energy absorption assembly 220 that flexibly couples the horizontal stud 142 and the upper mounting channel 140 to the upper blast track 144. The upper energy absorption assembly is shown in more detail in a cross-sectional end view in FIG. 7 and is also shown in a perspective view in FIG. 12 and an elevational view in FIG. 13.

Figure 7:
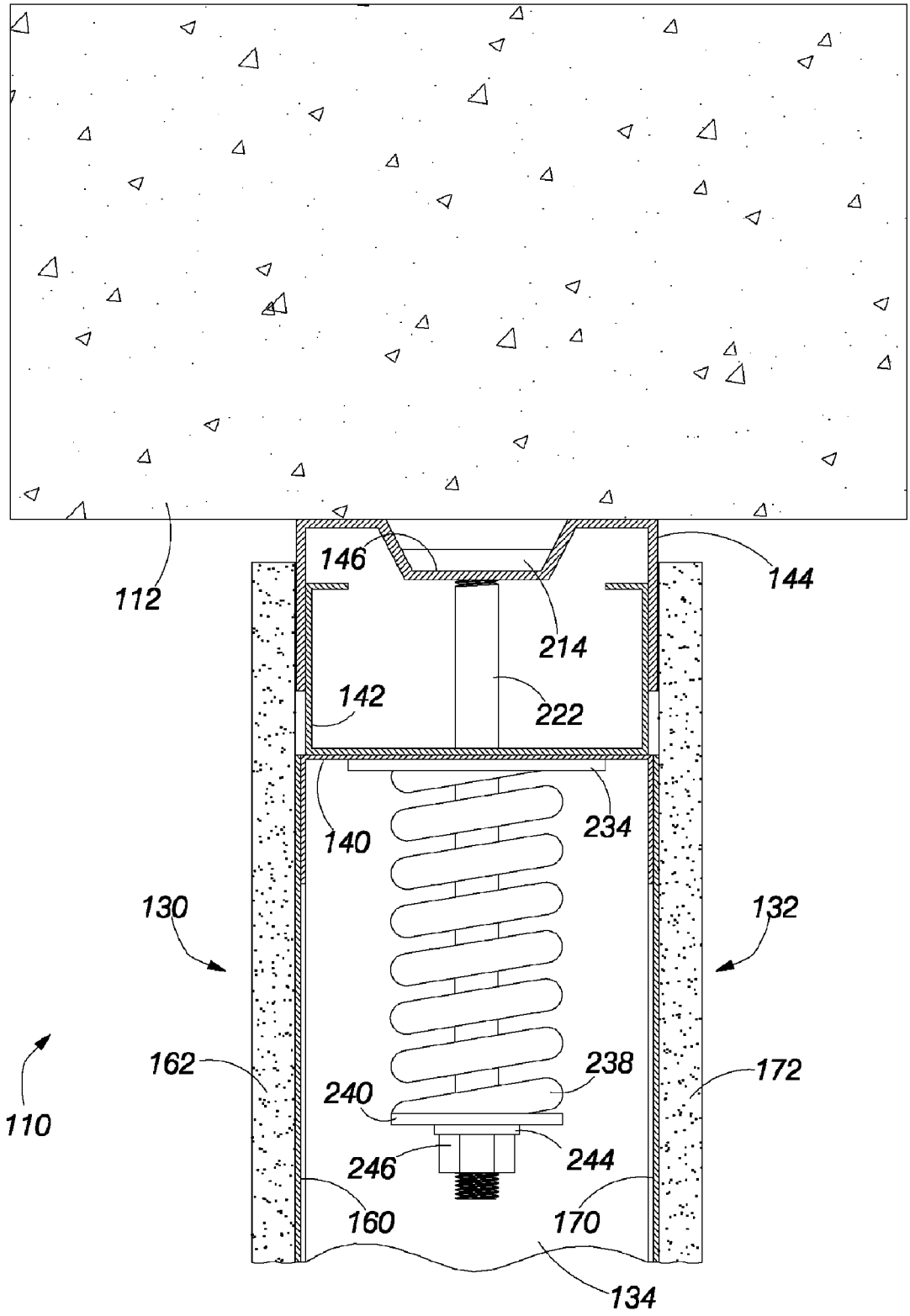
FIG. 7 illustrates an enlarged cross-sectional elevational end view in the direction of the lines 7-7 in FIG. 1 that shows the energy absorption system that couples the upper blast track to the floating blast wall.
Figure 12:
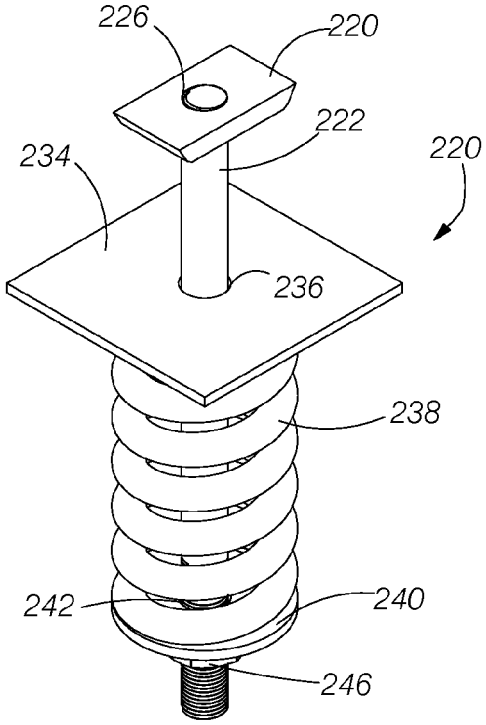
FIG. 12 illustrates an enlarged perspective view of the blast energy absorption assembly of FIG. 7.
Figure 13:
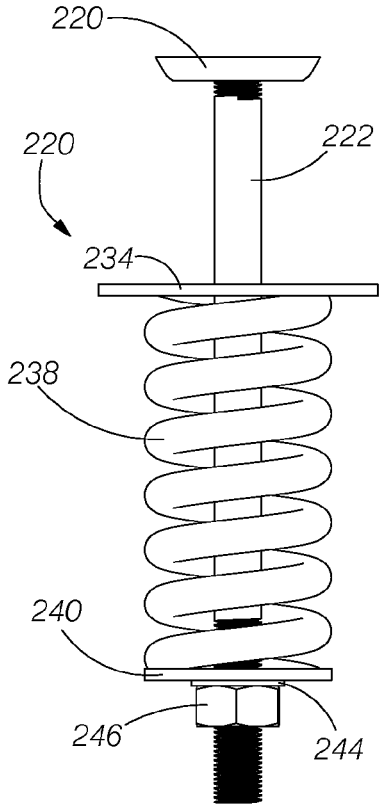
FIG. 13 illustrates an end elevation view of the blast energy absorption assembly of FIG. 12.

The upper energy absorption assembly 220 comprises a threaded rod 222 having a length of approximately 8 inches. The threaded rod may be threaded for the entire length, or, as illustrated in FIGS. 12 and 13, may be threaded only at the two ends. The threads at the upper end of the threaded rod engage the threads in a threaded hole 226 in an anchor wedge washer 224. As shown in FIG. 7, the anchor wedge has a generally trapezoidal profile selected to conform to the shape and size of the depressed portion 146 of the outer wall of the base of the upper blast track 144. The upper threaded portion of the threaded rod passes through one of a second plurality of holes 230 along the centerline of the depressed portion of the upper blast track. The second plurality of holes are shown in FIG. 18. In the illustrated embodiment, the second plurality of holes are spaced apart by 16 inches to correspond to the spacing of the vertical studs 134 so that an energy absorption assembly may be positioned in the space between each pair of adjacent vertical studs. In alternative embodiments, the energy absorption assemblies may be positioned only in every other space between the vertical studs (e.g., every 32 inches). In further alternative embodiments, the energy absorption assemblies may be positioned in every third space between the vertical studs (e.g., every 48 inches). The upper blast track may be formed with only the second plurality of holes needed for the selected alternative embodiment or may be formed with holes every 16 inches as shown. Preferably, the second plurality of holes are spaced apart from the first plurality of holes 206 so that the adjacent holes are no closer than 4 inches.

As shown in FIG. 7, the threaded rod 222 passes through the base of the horizontal stud 142 and through the base of the upper mounting channel 140. As illustrated in FIG. 20, the horizontal stud and the upper mounting channel include a plurality of clearance holes 232 that are spaced apart by the same distance as the second plurality of holes 230 of the upper blast track 144 (e.g., 16 inches in the illustrated embodiment). In FIG. 20, a portion of the side wall is broken away to show two of the clearance holes. The other clearance holes are hidden by the unbroken portion of the side wall.

As further illustrated in FIGS. 7, 12 and 13, the upper energy absorption assembly 220 further comprises a bearing washer 234 that comprises a generally square metal plate having sides of approximately 3 inches and having a thickness of approximately 1/8 inch. The bearing washer has a clearance hole 236 positioned substantially in the center of the square shape. For example, the clearance hole advantageously has a diameter of approximately 9/16 inch to accommodate the threaded rod 212.

When the upper energy absorption assembly 220 is positioned on the upper blast track 144, the bearing washer 234 is mounted below the base of the upper mounting track 140. The bearing washer applies pressure to the upper mounting track. The pressure is provided by a compression spring 238 that is positioned around the threaded rod between the bearing washer and a spring cap washer 240. The spring cap washer has a central clearance hole 242 that accommodates the lower end of the threaded rod 222. The spring cap washer comprises a 2-inch diameter steel plate having a thickness of approximately 1/16 inch. The spring cap washer is secured to the lower end of the threaded rod by a standard washer 244 and a hexagonal nut 246.

In the illustrated embodiment, the compression spring 238 advantageously comprises a 3/8 inch diameter steel wire formed as a helical spring having a diameter to the center of the wire of approximately 1 5/8 inches and having approximately 7 turns. The hexagonal nut 246 is threaded onto the threaded rod 222 to adjust the length of the spring between the bearing washer 244 and the spring cap washer 240. For example, in the illustrated embodiment, the initial length is adjusted to approximately 4 inches. The hexagonal nut may be loosened to increase the length and thereby reduce the force provided by the compression spring or tightened to decrease the length and thereby increase the force provided by the compression spring. The compression spring does not determine the static position of the upper end of the vertical stud 134. As described in detail below, the compression spring and the other elements of the upper energy absorption assembly 220 absorb blast energy and reduce the likelihood of a catastrophic failure of the blast wall assembly 110.

In alternative embodiments (not shown), the compression spring 236 may be replaced by a suitable thickness of an elastic rubber flange to provide the compression force for absorbing blast energy.

Figure 14:
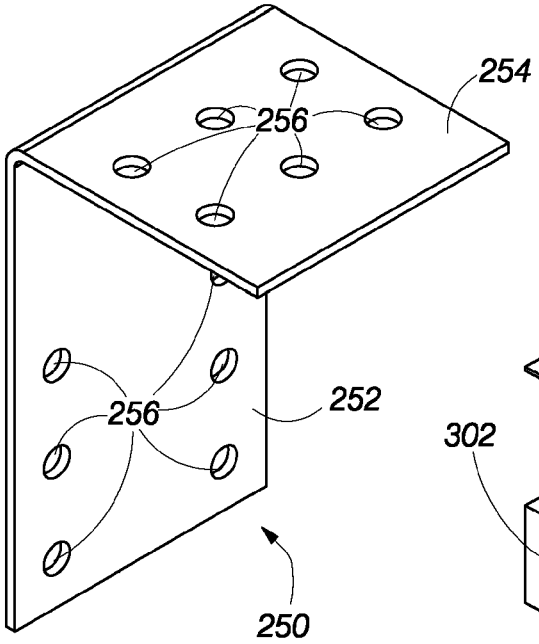
FIG. 14 illustrates a perspective view of the upper stud attachment clip of FIG. 5.

In conventional wall structures, the upper end of each vertical stud is secured to the upper mounting track via screws through the side walls of the mounting track that engage the side walls of the vertical stud. As shown in FIG. 2, the upper end of each vertical stud 134 is secured to the upper mounting track 140 and the horizontal stud 142 via an upper stud attachment blast clip 250, which is illustrated in the cross-sectional end view of FIG. 4 and which is shown in more detail in FIG. 5 and in FIG. 14. In the illustrated embodiment, the upper stud attachment blast clip comprises a rectangular plate of 12 gauge steel having a thickness of approximately 0.104 inch. The plate has a width of approximately 3 inches and has a length of approximately 8 inches. The plate is formed into an L shape having a longer leg 252 in a vertical orientation with a length of approximately 5 inches and having a shorter leg 254 in a horizontal orientation with a length of approximately 3 inches. Each leg has a plurality of mounting holes 256 (e.g., 6 holes) that provide clearances for the shafts of a corresponding plurality of mounting fasteners 258 that secure the blast clips to the vertical stud and to the upper mounting track and the horizontal stud. For example, the mounting fasteners advantageously comprise self-tapping sheet metal screws, such as, for example, 5/16 inch screws having hexagonal heads. The vertical stud, the upper mounting track and the horizontal stud may advantageously include drilled pilot holes positioned in alignment with the clearance holes to reduce the effort of inserting the mounting fasteners. For example, a plurality of pilot holes 260 are shown in the joined horizontal stud and upper mounting channel in FIG. 20. In accordance with this configuration, the side walls of the upper mounting track and the horizontal stud are unobstructed so that the horizontal stud may move freely within the upper blast track as described above.

Figure 3:
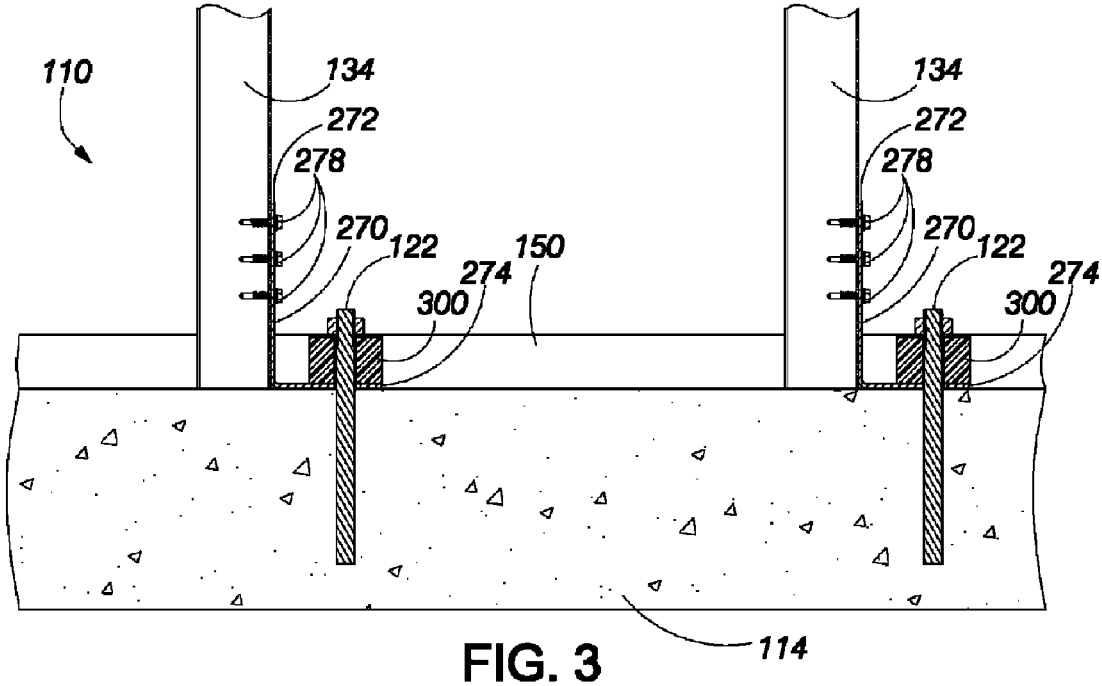
FIG. 3 illustrates an enlarged cross-sectional elevational view of a portion of the lower concrete footer, the bottom track, the lower ends of two vertical studs and the energy absorption pad viewed in the direction of the lines 3-3 in FIG. 1.

FIG. 3 illustrates an enlarged cross-sectional elevational view of a portion of the lower concrete footer 114, the bottom channel 150, and the lower ends of two vertical studs viewed in the direction of the lines 3-3 in FIG. 1.

Figure 4:
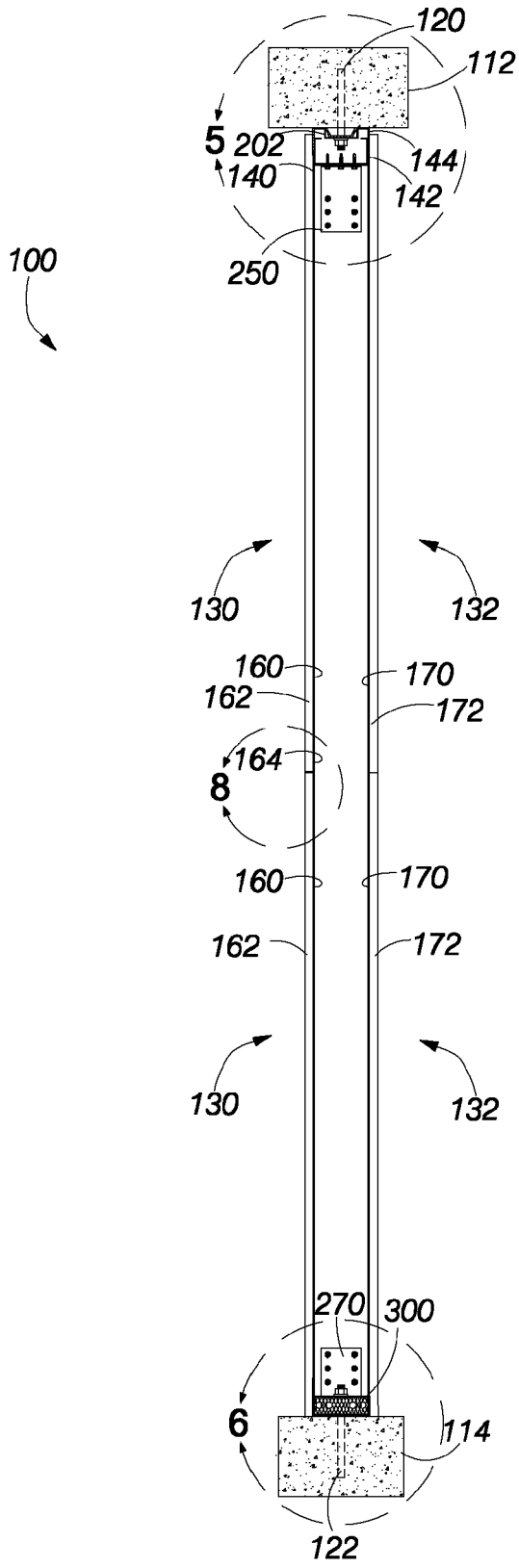
FIG. 4 illustrates an elevational cross-sectional end view of the blast wall of FIG. 1 in the direction of the lines 4-4 in FIG. 1 that shows the attachment structures at the top and bottom portions of an exemplary vertical stud and which further shows the structure of the inner blast panel (to the left in FIG. 4) and the outer blast panel (to the right in FIG. 4)
Figure 6:
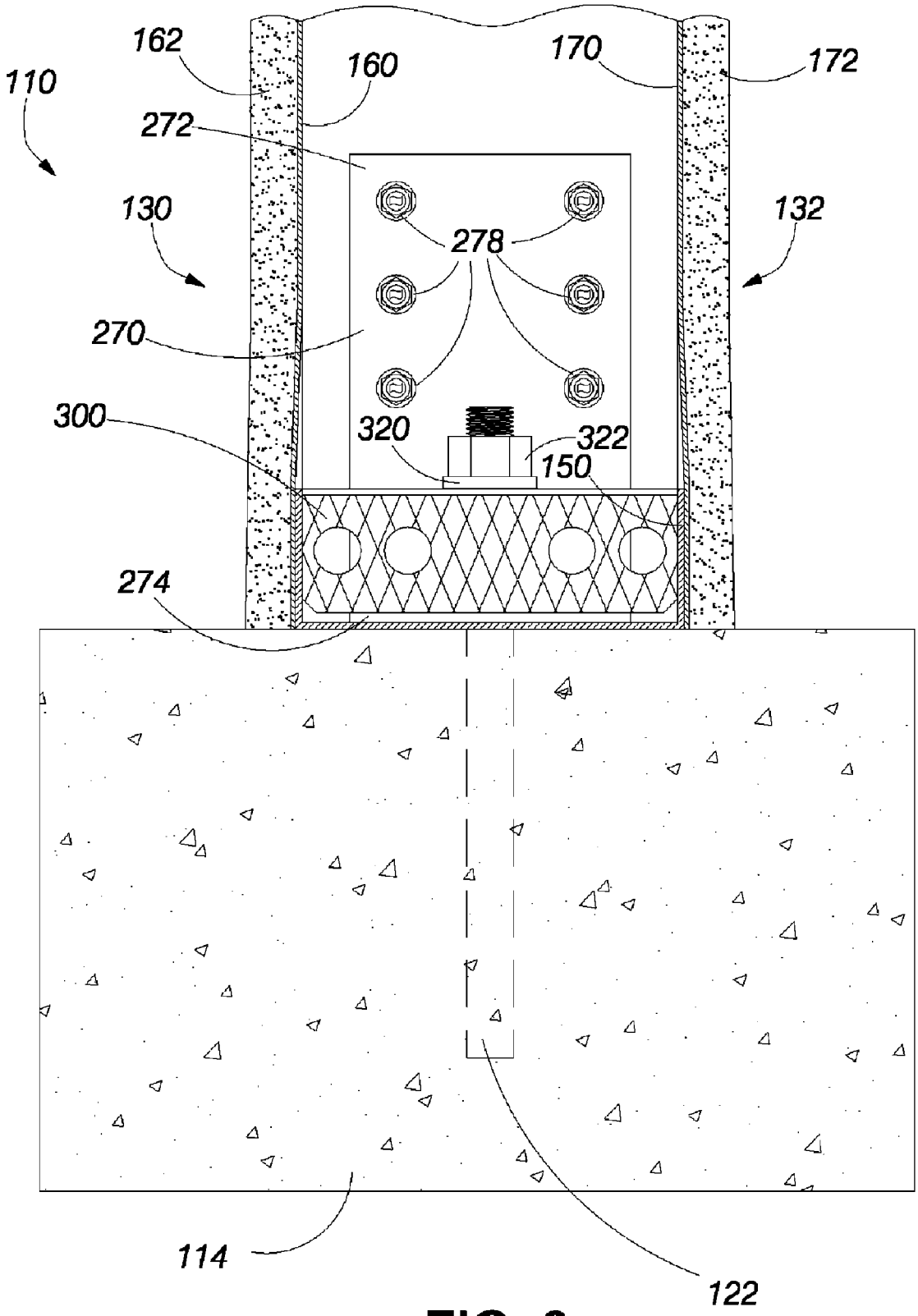
FIG. 6 illustrates an enlarged cross-sectional elevational end view of the bottom portion of the vertical wall stud of FIG. 4 bounded by the circular area 6 in FIG. 4.
Figure 15:
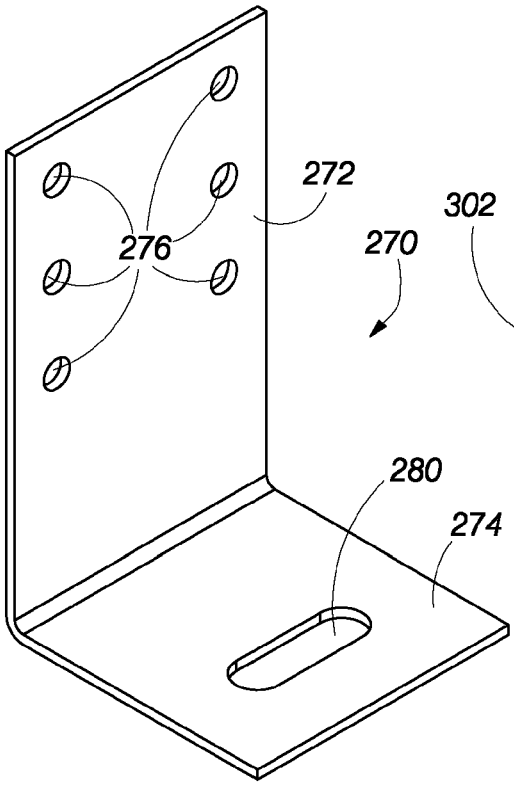
FIG. 15 illustrates a perspective view of the lower stud attachment clip of FIG. 6.

As shown in FIG. 3, the lower end of each vertical stud 134 is secured to the lower mounting track 150 via a lower stud attachment blast clip 270, which is illustrated in the cross-sectional end view in FIG. 4 and which is shown in more detail in FIG. 6 and FIG. 15. The lower stud attachment blast clip also comprises steel and has a length, width and thickness similar to the length, width and thickness corresponding to the upper stud attachment blast clip 250. The lower stud attachment blast clip is formed into a longer vertical leg 272 and a shorter horizontal leg 274 having similar dimensions to the upper stud attachment blast clip. The lower stud attachment blast clip has a plurality of mounting holes 276 (e.g., 6 holes) in the longer vertical leg to provide clearance for the shafts of a corresponding plurality of mounting fasteners 278.

As shown in FIG. 15, an oval-shaped mounting hole 280 is formed in the horizontal leg 274 of the lower stud attachment blast clip 270. For example, in the illustrated embodiment, the mounting hole has a width of approximately ½ inch and has a semicircular arc at each end with a radius of ½ inch. The centers of the arcs are spaced apart by approximately 1 inch. As shown in FIGS. 3, 4 and 6, the lower stud attachment blast clip is secured to the lower end of the vertical stud and is positioned with the lower anchor bolt 122 substantially in the center of the oval-shaped mounting hole. The length of the mounting hole allows the lower stud attachment blast clip to move laterally with respect to the lower footer 114.

Figure 22:
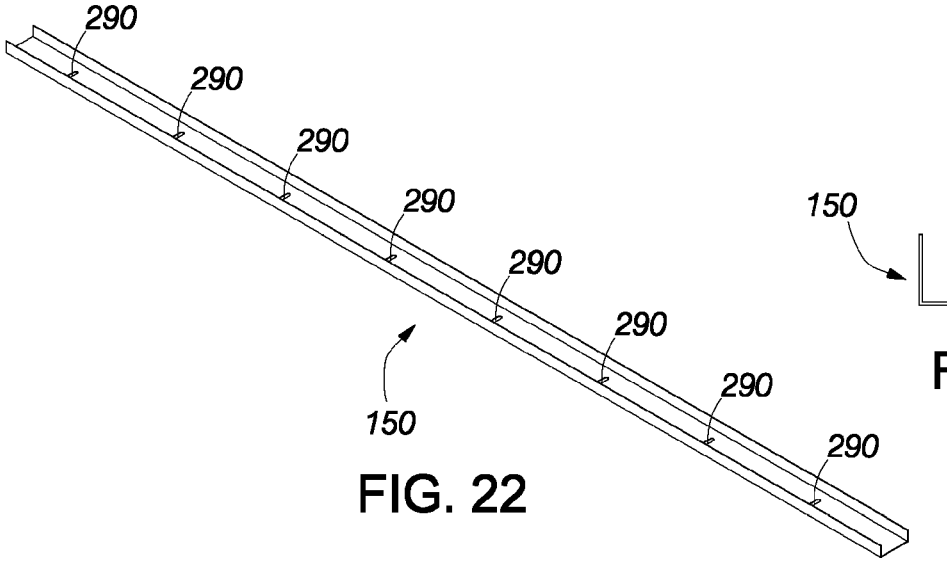
FIG. 22 illustrates a perspective view of the lower mounting channel (track) of FIG. 1 to show the slotted holes for attaching the lower mounting channel to the lower concrete footer.
Figure 23:
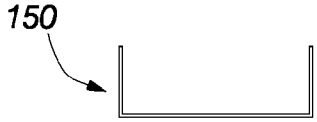
FIG. 23 illustrates an end elevational view of the lower mounting channel of FIG. 22 to show a preferred cross section for the lower mounting channel.

As shown in FIG. 22, the lower mounting channel 150 includes a plurality of oval-shaped mounting holes 290 having dimensions corresponding to the dimensions of the mounting hole 280 in the lower stud attachment blast clip 270. The mounting holes in the lower mounting channel are spaced apart by the selected spacing of the vertical studs 134 (e.g., 16 inches center-to-center in the illustrated embodiment). The lower mounting channel is positioned over the lower anchor bolts 122 first and then the lower stud attachment blast clips for the vertical studs are positioned over the lower anchor bolts.

The lower mounting channel 150 and the lower attachment blast clip 270 are secured to the lower anchor bolt by placing a lower blast absorption pad 300 on the lower anchor bolt above the lower leg 274 of the lower attachment blast clip as shown in FIGS. 3, 4 and 6. As illustrated in more detail in FIG. 16, the lower blast absorption pad advantageously comprises a block 302 of an elastomer, such as, for example, ethylene propylene diene monomer (EPDM) rubber. In the illustrated embodiment, the elastomer block has a rectangular cross section in the plan view (e.g., looking from the top) with a width of approximately 2 inches and a length of approximately 4 inches. The length is advantageously increased when a wider lower mounting channel is used for a thicker wall. The elastomer block has a thickness of approximately 1.25 inches and has a substantially rectangular face in the end elevational view. In the preferred embodiment, the lower corners of the rectangular face are chamfered to accommodate any reduction in the channel width caused by rounding or filleting at the intersections of the vertical walls and the base of the lower mounting channel.

The elastomer block 302 has a bore 304 that is centrally located through the rectangular upper surface and that extends vertically through the block. In the illustrated embodiment, the vertical bore has a diameter of approximately 9/16 inches to accommodate the diameter of the lower anchor bolt 122.

The elastomer block 302 further includes a plurality of horizontal bores 306 that extend through the block orthogonal to the vertical bore 304. For example, in the illustrated embodiment, the block includes four horizontal bores with two bores located on either side of the vertical bore. The horizontal bores advantageously have diameters of approximately ½ inch. The absence of the EPDM material in the horizontal bores reduces the force required to compress the elastomer bock.

Figure 16:
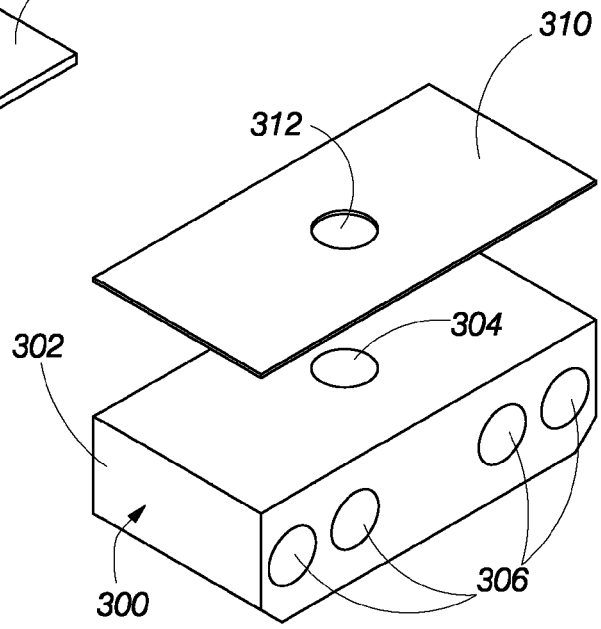
FIG. 16 illustrates an exploded perspective view of the elastomer block and the metal plate of the energy absorption pad of FIG. 6

As further shown in FIG. 16, the lower blast absorption pad further includes a rectangular metal plate 310 having rectangular dimensions in the plan view substantially similar to the rectangular dimensions of the upper surface of the elastomer block 302. The metal plate advantageously comprises 20 gauge steel having a thickness of approximately 0.0375 inch. The rectangular metal plate includes a central circular hole 312 having substantially the same diameter as the vertical bore 304 of the elastomer block.

Figure 17:
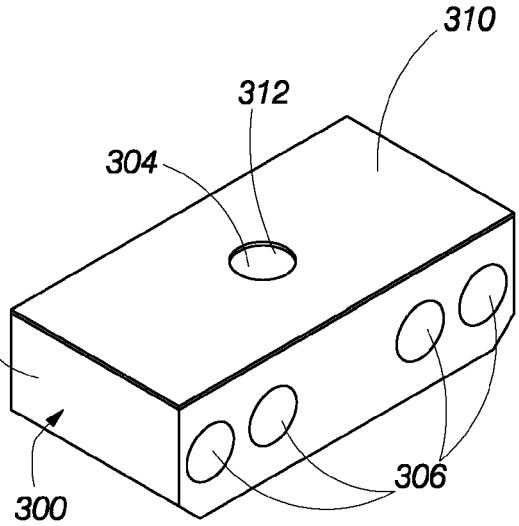
FIG. 17 illustrates a perspective view of the assembled energy absorption pad of FIG. 6.

As shown in the assembled view of the lower blast absorption pad 300 in FIG. 17, the rectangular metal plate 310 is bonded to the upper surface of the elastomer block 302 with the edges substantially in alignment with the edges of the elastomer block and with the central circular hole 312 substantially aligned with the vertical bore 304. The metal plate is advantageously bonded to the elastomer block using epoxy, glue or another suitable adhesive.

As shown in FIG. 6, for example, the lower blast absorption pad 300 is mounted in the lower mounting channel 150 with the lower anchor bolt 122 passing through the vertical hole 304 and the circular hole 312 and with the rectangular metal plate 310 facing upward. The lower blast absorption pad is secured to the lower anchor bolt by a standard washer 320 and a hexagonal nut 322. The nut is tightened onto the lower anchor bolt to partly compress the elastomer block 302 to provide sufficient pressure so that the lower mounting channel and the lower end of the vertical stud 134 do not move when ordinary pressure is applied to the inner or outer surface of the blast wall assembly 110.

The blast wall assembly 110 and the components described above form an integrated system that effectively absorbs blast energy. Unlike conventional systems, the components of the blast wall assembly function in a manner similar to highway "crumple zones" by absorbing the energy generated by the sudden impact of a blast wave on the exterior surface of the blast wall. The components of the blast wall assembly flex, move, compress, crush and bend before the full magnitude of the blast load is transmitted via the components to the fasteners used to secure the assembly to the structure. By absorbing the sudden impact of energy, the system greatly reduces the likelihood of component failure and fastener failure. Although the blast wall assembly may incur repairable damage, the blast wall assembly absorbs a substantial portion of the blast energy rather than imploding into the interior space of the structure. Thus, the blast wall assembly greatly enhances the safety of the building structure and the occupants of the building structure.

When a blast pressure wave first impacts the exterior blast board, the exterior blast board (the outer blast panel 132) resists penetration by objects, such as rocks and shrapnel, which may be hurled against the wall by the blast force. A portion of the energy of the blast wave is absorbed by flexural bending of the exterior blast board. The load applied to the exterior blast board by the blast pressure wave is transferred to the vertical wall studs 134. The exterior blast board also provides lateral bracing for the vertical studs, which helps prevent torsional failure of the light gauge vertical studs. The exterior blast board also serves as a substrate for a variety of exterior finish systems that may be applied to the cementitious wall board forming the outer face of the exterior blast board. Thus, from the outside, the blast wall assembly 110 may be configured to have the cosmetic appearance of a conventional wall.

The light gauge (e.g., 16 gauge) vertical wall studs 134 are flexible. Thus, when the load from the blast pressure wave is applied to the wall studs via the outer blast panel 132, the wall studs bend and deform and eventually stretch. The magnitude of deformation of the wall studs may exceed the yield strength of the wall studs and cause a portion of the deformation to be permanent. The bending, deformation and stretching of the studs absorbs additional blast energy.

As each vertical wall stud 134 deforms inward away from the blast force, the stud has a tendency to pull out of the upper mounting channel 140 and the lower mounting channel 150 that constrain the upper end and the lower end, respectively, of each stud. The angle clip (the upper stud attachment blast clip 250) at the top of each vertical stud and the angle clip (the lower stud attachment blast clip 270) at the bottom of each stud resist this pull-out force. In particular, the top angle clip and the bottom angle clip for each stud resist disengagement of the stud from the upper mounting channel and the lower mounting channel while simultaneously absorbing blast energy. As the vertical stud deflects inwardly, the chord distance between the top end and the bottom end of the stud shortens. The horizontal legs 254, 274 of the angle clips deform by bending in response to the tensile force that attempts to straighten the angle clips. The deformations of the angle clips absorb additional blast energy.

When the bottom angle clip (the lower stud attachment blast clip 270) deforms, the tendency of the bottom angle clip to straighten is resisted by the bottom energy absorbing pad 300. The bottom energy absorbing pad is compressed vertically as the horizontal leg 274 attempts to pull away from the lower mounting channel 150. The compression of the bottom energy absorbing pad absorbs additional blast energy. The metal plate 310 laminated to the top of the bottom energy absorbing pad helps prevent the pad from pulling over an anchor bolt 120 at the bottom of the wall and prevents the pad from being crushed by the hexagonal nut 320 that secures the pad to the bottom attachment anchor bolt.

The bottom energy absorbing pads 300 at the bottoms of the wall studs also absorb energy while allowing the entire base of the wall to move inward away from the blast. As described above, the bottom mounting channel (or track) 150 and the bottom clips (the lower stud attachment blast clip 270) include respective slots (or oversized holes) 290, 280 that permit the entire lower portion of the blast wall assembly 110 to move inward away from the blast force until reaching the end of the slot or the boundary of the oversized hole. The bottom energy absorbing pads prevent the wall from moving too quickly and applying a shock load to the lower anchor bolts 120. When the bottom energy absorbing pads compress under load, the pads create a more gradual (cushioned) increase in the load to the wall anchors. Thus, the bottom energy absorbing pads help preserve the integrity of the critical attachment of the wall to the building structure.

The upper mounting system 200 and the upper energy absorbing assembly 220 at the top of the blast wall assembly 110 absorb blast energy and resist destructive movement caused by the blast energy. The upper mounting system and the upper energy absorbing assembly also permit the floor above the blast wall assembly to deflect vertically in response to changing live loads to the floor above the wall, the floor below the wall or both. The floating configuration of the upper mounting allows deflections to occur without transferring axial loads (e.g., bearing loads) to the wall. The blast wall assembly disclosed herein can be used as either a non-bearing partition wall or as a curtain wall.

When a top angle clip (the lower stud attachment blast clip 250) deforms, the tendency of the clip to straighten is reduced by the bending of the horizontal flange stud 142 that spans the approximately 24-inch spacing between adjacent upper mounting systems 200. The tensile force caused by a blast causes the angle clip to bend (e.g., straighten) and induces weak axis bending in the horizontal flange stud. The horizontal flange stud also provides an engagement between the vertical wall studs and the upper blast track 144. In particular, the outer surfaces of the vertical walls of the horizontal flange stud ride may float up or down within the cavity formed by the upper blast track. The floating engagement between the horizontal stud and the upper blast track is configured to reduce the effect of the blast forces. As described above, the top angle clip and the horizontal flange stud are nested so that the side walls of the horizontal flange stud are unobstructed within the upper blast track to thereby accommodate vertical movement between the floor above and the wall below. Additional blast energy is absorbed by bending of the horizontal stud flange and bending of the flange of the upper blast track on the side of the wall opposite the blast. Both components bend in a direction normal to the plane of the wall.

Lateral movement of the blast wall assembly 110 in a direction normal to the wall plane is primarily resisted by bending of a down-turned flange of the upper blast track 144. As each vertical stud 134 bends, the chord distance between the upper and lower ends of the vertical stud shortens as discussed above. The spring 238 or other elastic member in the upper energy absorption assembly 220 compresses to absorb blast energy. Once the spring in the energy absorbing assembly is fully compressed, the threaded steel rod 222 in the assembly transmits tensile loads to the upper blast track through the anchor wedge washer 224 described above. As the wall deforms inward, the threaded rod pivots to transfer tensile load and shear load to the upper blast track, which causes the upper blast track to deform in the vicinity of the wedge washer. The deformation of the upper blast track absorbs more blast energy.

Once the blast load is transferred to the upper blast track 144 by bending the outer wall (the flange of the upper blast track) and by the upper energy absorption assembly 220, the transferred load is transferred to the building structure by way of the upper anchor bolt 120 embedded in the concrete header 112. The force transferred to the upper anchor bolt is cushioned by the deformation of the trapezoidal channel (the depressed portion 146) in the upper blast track and by the vertical flange and weak axis bending of the U-shaped blast track anchor channel 202. The shape of the blast track in combination with the blast track anchor channel results in a more gradual transfer of forces to the top connection, which helps preserve the integrity of the top connection and of the blast wall assembly 110.

The blast wall assembly further comprises an interior blast board (the inner blast panels 130). Each panel of the interior blast board comprises a layer of metal 160 and an interior finish wall board 162 to form a generally rectangular sheet. The interior blast board is fabricated with a metal flange 164 extending along one of the long edges. The long edges are oriented horizontally in the preferred embodiments. The metal flange allows the interior sheathing to be spliced to the adjacent sheathing (the inner blast panel immediately above). The splice effectively connects the upper and lower sheathing boards to form a continuous protective curtain reaching from the top to the bottom of the wall. If one or more sheets become dislodged, the dislodged sheets remain in place on the wall and pose no hazard to the building occupants. Preferably, the sheets are positioned on the wall with the locations of the splices staggered so that the splices do not coincide with the utility punch outs in the vertical studs of the wall. Thus, the interior blast board reinforces the wall and helps prevent stud failure at the utility punch-outs. Furthermore, the metal lined interior blast boards provide torsional restraint for the vertical studs 134 to effectively prevent torsional failure of the vertical studs.

One skilled in art will appreciate that the foregoing embodiments are illustrative of the present invention. The present invention can be advantageously incorporated into alternative embodiments while remaining within the spirit and scope of the present invention, as defined by the appended claims.

What is claimed is:

1. A wall system for protecting a building structure from pressure caused by explosive blasts, comprising:

a plurality of vertical studs having respective upper ends and lower ends;

at least one outer blast wall panel secured to respective outer sides of the vertical studs;

at least one inner blast wall panel secured to respective inner sides of the vertical studs;

an upper mounting system attached to the building structure, the upper mounting system including a fixed track, a movable mounting track that is movable vertically with respect to the fixed track, and an energy absorbing system that elastically couples the movable mounting track to the fixed track, the upper ends of the vertical studs attached to the moveable mounting track; and a lower mounting system comprising a mounting track that aligns the lower ends of the vertical studs and a respective attachment clip for each vertical stud, each attachment clip attached to the building structure with an elastomeric energy absorption pad that elastically resists vertical and lateral movement of the lower end of the respective vertical stud;

wherein the fixed track comprises a channel having a base coupled to the building structure and two sides extending downward from the base; and the movable mounting track is positioned between the two walls of the fixed track to move vertically within the fixed track.

2. The wall system as defined in claim 1, wherein the energy absorbing system comprises:

a rod having a first end that engages a base of the support track, the rod passing through a base of the movable mounting track; and an elastic member mounted between a second end of the rod and the base of the movable mounting track, the elastic member absorbing a portion of blast energy that causes movement of the movable mounting track with respect to the fixed track.

3. The wall system as defined in claim 1, wherein:

the outer blast wall panel comprises:

a generally rectangular metal sheet; and an exterior wall board laminated to the metal sheet; and the outer blast wall panel is secured to the vertical studs with the metal sheet positioned against the vertical studs and with the exterior wall board facing outward.

4. The wall system as defined in claim 1, wherein:

the inner blast wall panel comprises:

a generally rectangular metal sheet; and an interior wall board laminated to the metal sheet; and the inner blast wall panel is secured to the vertical studs with the metal sheet positioned against the vertical studs and with the interior wall board facing inward.

5. The wall system as defined in claim 4, wherein:

the metal sheet of at least a first inner blast wall panel has at least one dimension larger than a corresponding dimension of the interior wall board to form a metal tab extending from at least one edge of the interior wall board; and the first inner blast wall panel is secured to the vertical studs with the metal tab extending upward from the first inner blast wall panel, and at least a second inner blast wall panel is mounted above the first inner blast wall panel with the metal sheet of the second inner blast wall panel overlapping the metal tab of the first inner blast wall panel.

6. A wall system for protecting a building structure from pressure caused by explosive blasts, comprising:

a plurality of vertical studs having respective upper ends and lower ends;

at least one outer blast wall panel secured to respective outer sides of the vertical studs;

at least one inner blast wall panel secured to respective inner sides of the vertical studs;

an upper mounting system to receive the upper ends of the vertical studs, the upper mounting system comprising:

a support track fixed to the building structure;

an upper movable mounting channel movable vertically with respect to the support track, the upper movable mounting channel fixed to the upper ends of the vertical studs; and an energy absorption assembly that elastically couples the upper movable mounting channel, to the support track, the energy absorption assembly resisting vertical movement of the upper movable mounting channel with respect to the support track to thereby absorb blast energy applied to the at least one outer blast wall panel; and a lower mounting system to receive the lower ends of the vertical studs, the lower mounting system comprising:

a lower mounting channel that receives the lower ends of the vertical studs;

a respective lower angle clip having a vertical leg attached to a lower portion of one of the vertical studs and having a horizontal leg positioned in the lower mounting channel, the horizontal leg having a clearance opening to engage an anchor bolt attached to the building structure; and an elastomeric energy absorption pad positioned over the clearance opening in the horizontal leg of the angle clip to apply pressure to the horizontal leg of the angle clip and to the lower mounting channel to secure the angle clip and the lower mounting channel to the building structure, the elastomeric energy absorption pad flexibly resisting vertical and lateral movement of the angle clip and the lower mounting channel to thereby absorb a portion of blast energy applied to the at least one outer blast wall panel.

7. The wall system as defined in claim 6, wherein:

the support track comprises a channel having a base and two sides, the base of the support track mounted to the building structure, the two sides extending downward from the base; and the upper movable mounting channel is positioned between the two walls of the support track to move vertically within the support track.

8. The wall system as defined in claim 7, wherein:

the outer wall of the base of the support track includes an indented middle portion having a generally trapezoidal shape, and the inner wall of the base of the support track includes a corresponding trapezoidal protrusion;

the support track is mounted to the building structure via a generally U-shaped channel positioned over the protrusion and an anchor bolt positioned through the U-shaped channel and the protrusion and secured to the building structure; and blast energy coupled to the support track and causing the support track to bend is absorbed by deformation of the trapezoidal protrusion.

9. The wall system as defined in claim 6, wherein the energy absorption system comprises:

a rod having a first end and a second end, the first end engaging the support track, the rod passing through the upper movable mounting channel; and an elastic member mounted between the second end of the rod and the upper movable mounting channel, the elastic member absorbing a portion of blast energy that causes movement of the upper movable mounting channel with respect to the support track.

10. The wall system as defined in claim 9, wherein the elastic member comprises a spring.

11. The wall system as defined in claim 6, wherein:

the elastomeric energy absorption pad comprises an elastomer block having a metallic plate positioned on an upper surface, the elastomer block and the metallic plate having a vertical bore therethrough;

the elastomeric energy absorption pad is positioned over the anchor bolt secured to the building structure and is secured to the anchor bolt to apply pressure to the angle clip and the lower mounting channel; and the elastomer block absorbs a portion of blast energy that causes movement of the lower mounting channel and the lower end of the respective vertical stud.

12. The wall system as defined in claim 11, wherein the elastomer block further comprises a plurality of horizontal bores to reduce the force required to compress the elastomer block.

13. The wall system as defined in claim 6, wherein:

the outer blast wall panel comprises:

a generally rectangular metal sheet; and an exterior wall board laminated to the metal sheet; and the outer blast wall panel is secured to the vertical studs with the metal sheet positioned against the vertical studs and with the exterior wall board facing outward.

14. The wall system as defined in claim 6, wherein:

the inner blast wall panel comprises:

a generally rectangular metal sheet; and an interior wall board laminated to the metal sheet; and the inner blast wall panel is secured to the vertical studs with the metal sheet positioned against the vertical studs and with the interior wall board facing inward.

15. The wall system as defined in claim 14, wherein:

the metal sheet of at least a first inner blast wall panel has at least one dimension larger than a corresponding dimension of the interior wall board to form a metal tab extending from at least one edge of the interior wall board; and the first inner blast wall panel is secured to the vertical studs with the metal tab extending upward from the first inner blast wall panel, and at least a second inner blast wall panel is mounted above the first inner blast wall panel with the metal sheet of the second inner blast wall panel overlapping the metal tab of the first inner blast wall panel.

16. A wall system for protecting a building structure from pressure caused by explosive blasts, comprising:

a plurality of vertical studs having respective upper ends and lower ends;

at least one outer blast wall panel secured to respective outer sides of the vertical studs;

at least one inner blast wall panel secured to respective inner sides of the vertical studs;

an upper mounting system to receive the upper ends of the vertical studs, the upper mounting system comprising:

a support track fixed to the building structure; an upper mounting channel coupled to the support track and movable vertically with respect to the track, the mounting channel fixed to the upper ends of the vertical studs, wherein the upper end of each vertical stud is secured to the upper mounting channel by a respective upper angle clip, the upper angle clip having a vertical leg attached to the vertical stud and having a horizontal leg attached to the inner surface of the base of the upper mounting channel; and an energy absorption assembly coupled between the support track and the upper mounting channel, the energy absorption assembly resisting movement of the upper mounting channel with respect to the support track to thereby absorb blast energy applied to the at least one outer blast wall panel; and a lower mounting system to receive the lower ends of the vertical studs, the lower mounting system comprising: a lower mounting channel that receives the lower ends of the vertical studs;

a respective lower angle clip having a vertical leg attached to a lower portion of one of the vertical studs and having a horizontal leg positioned in the lower mounting channel, the horizontal leg having a clearance opening to engage an anchor bolt attached to the building structure; and an energy absorption pad positioned over the clearance opening in the horizontal leg of the angle clip to apply pressure to the horizontal leg of the angle clip and to the lower mounting channel to secure the angle clip and the lower mounting channel to the building structure, the energy absorption pad resisting vertical and lateral movement of the angle clip and the lower mounting channel to thereby absorb a portion of blast energy applied to the at least one outer blast wall panel.

* * * * *